United States Patent [19]

Havard

[11] 4,456,224

[45] Jun. 26, 1984

[54] JACKING MECHANISM FOR SELF-RAISING OCEAN PLATFORMS

[75] Inventor: Jean F. Havard, Carquefou, France

[73] Assignee: Brissonneau et Lotz Marine, Carquefou-Nantes, France

[21] Appl. No.: 339,738

[22] Filed: Jan. 15, 1982

[51] Int. Cl.[3] ..... B66F 7/12

[52] U.S. Cl. ..... 254/89 R; 254/95; 74/422

[58] Field of Search ..... 74/422, 410, 89.17, 74/109; 187/95; 254/89 R, 89 H, 95–97, 105; 405/203, 196–199

[56] References Cited

U.S. PATENT DOCUMENTS

| | | | |
|---|---|---|---|
| 1,850,070 | 3/1932 | Booth | 74/422 |
| 2,170,595 | 8/1939 | Povandra | 254/97 |
| 2,781,668 | 2/1957 | Berta | 74/422 |
| 3,302,750 | 2/1967 | Arnold | 187/95 |
| 3,399,578 | 9/1968 | Lindabury | 254/95 |
| 3,420,337 | 1/1969 | Magee | 187/95 |
| 4,203,576 | 5/1980 | Button | 254/89 R |

OTHER PUBLICATIONS

*Lapis Industrial Opportunities,* "Platform Jacking Mechanisms", No. 37, Oct. 1961, pp. 21–24.

*Primary Examiner*—Robert C. Watson

*Attorney, Agent, or Firm*—Rines and Rines, Shapiro and Shapiro

[57] ABSTRACT

The present invention pertains to self-raising ocean platforms which possess multiple legs and multiple jacking mechanisms of the double rack and pinion type with opposite sets of teeth. In accordance with the invention, each double rack 4 contains sets of obliquely cut teeth, with at least one rigid component constituting a lateral thrust-block 7 being situated between the platform structure 2 and each platform leg 1, in such a manner that this arrangement provides force, c, which tends to press one portion of the platform leg 1 against the thrust-block 7, thereby ensuring constant positioning of the pinion teeth 5 in relation to the set of teeth located upon the rack 4.

7 Claims, 2 Drawing Figures

JACKING MECHANISM FOR SELF-RAISING OCEAN PLATFORMS

The present invention pertains to ocean platforms of the self-raising type, which are specifically designed for conducting ocean drilling operations and the like. These platforms possess multiple legs, accompanied by multiple jacking mechanisms of the rack and pinion type which permit adjustment of the position of a platform and secure positioning of said platform upon the aforementioned legs.

For this purpose, a double rack with opposite sets of teeth, accompanied by a jacking mechanism including at least one pair of pinions which are flexibly or rigidly attached to the platform structure by means of a frame, is firmly attached to each leg of the platform. Each of the aforementioned pinions respectively meshes with one of the two sets of teeth situated upon the previously cited rack, and it can be rotated by means of drive mechanisms and reducing mechanisms, so as to permit necessary movements in different directions. An example of this type of jacking mechanism has been described in an article entitled "Platform Jacking Mechanisms," in the periodical *Lapis Industrial Opportunities*,No. 37, October, 1961, on pages 21 thorugh 24.

With this type of system, one of the difficulties which has been observed is derived from the fact that heavy and cumbersome metal structures are necessary in order to ensure lateral positioning of teeth situated upon racks in relation to the sets of pinion teeth, inasmuch as underwater currents and wind cause the legs of a platform to shift slightly in relation to jacking mechanisms.

Moreover, when the frame has been allowed to shift in relation to the platform structure, steady contact between the teeth situated on the rack and the various sets of pinion teeth ceases as soon as the frame tilts in relation to a vertical position, and this problem is intensified by substantial reverse momentum resulting from the weight of the frame and from the fact that its center of gravity is relatively far away from the rack.

An object of the present invention, accordingly, is to provide a new and improved jacking mechanism that remedies these difficulties by means of an improved rack and pinion type of jacking mechanism designed to provide precise and automatic lateral positioning of the platform legs in relation to the jacking mechanisms, with the same being mounted so that they can shift in relation to the platform structure, or be welded to the platform structure.

A further object is to provide a novel jacking mechanism of more general application, as well.

Other and further objects will be explained hereinafter and are more particularly delineated in the appended claims.

In summary, however, in accordance with the invention, the double rack contains sets of teeth which are obliquely cut, and it contains at least one rigid component which constitutes a lateral thrust-block, to be placed lengthwise between the platform and each of its legs, with the thrust-block being integrally attached to the frame for the jacking mechanism.

One advantage offered by this particular arrangement is that the frames to which the pinions are attached can be self-centering. Consequently, stresses applied to the legs can be placed in equilibrium, and, in certain instances, these stresses can therefore be diminished.

The characteristics and advantages of the present invention can be more fully understood in relation to the following description and in relation to the accompanying drawing which represents two preferred and best mode applications of the invention as non-restrictive examples of the practice of the invention.

Figure 1:
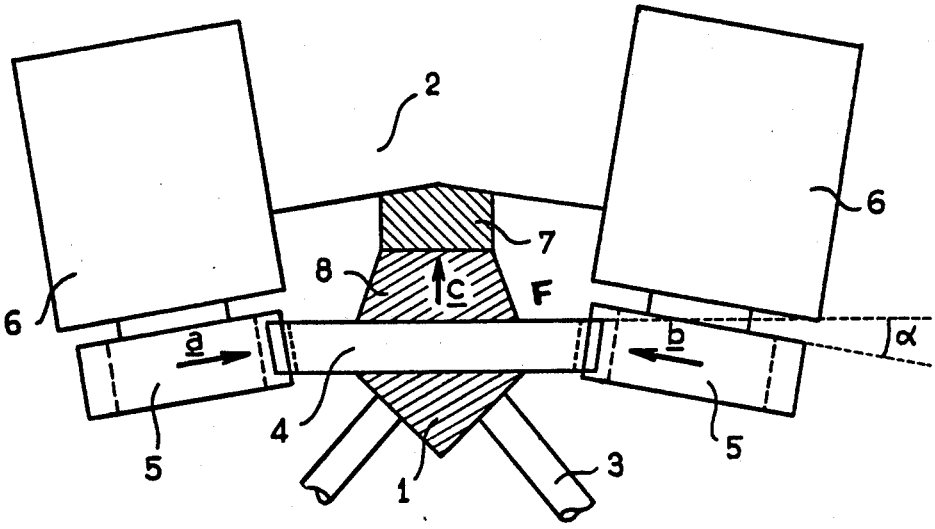
FIG. 1 illustrates a partial horizontal section of a platform leg which has been outfitted with a jacking mechanism designed in accordance with the present invention.

Within these illustrations, the reference 1 corresponds to one of the legs of a platform 2, while 3 designates the struts for the frame work, which are arranged in the form of a lattice, in conjunction with the platform legs. A double rack 4 is shown having obliquely cut teeth and being firmly attached to the platform leg 1. The corresponding pinions 5, which are mounted within a conventional frame and are turned by drive mechanisms and reducing mechanisms 6, are capable of meshing with the sets of teeth situated upon the rack 4. The frame, which is not shown in detail but is represented at F, is mounted so that it is capable of shifting in relation to the platform, by means of flexible bearings, for example; or, alternatively, the frame F can be firmly welded to the platform 2.

A lengthwise thrust-block 7, which is integrally attached to the platform 2 is situated opposite a guide element 8, and this element is integrally attached to the platform leg 1.

Figure 2:
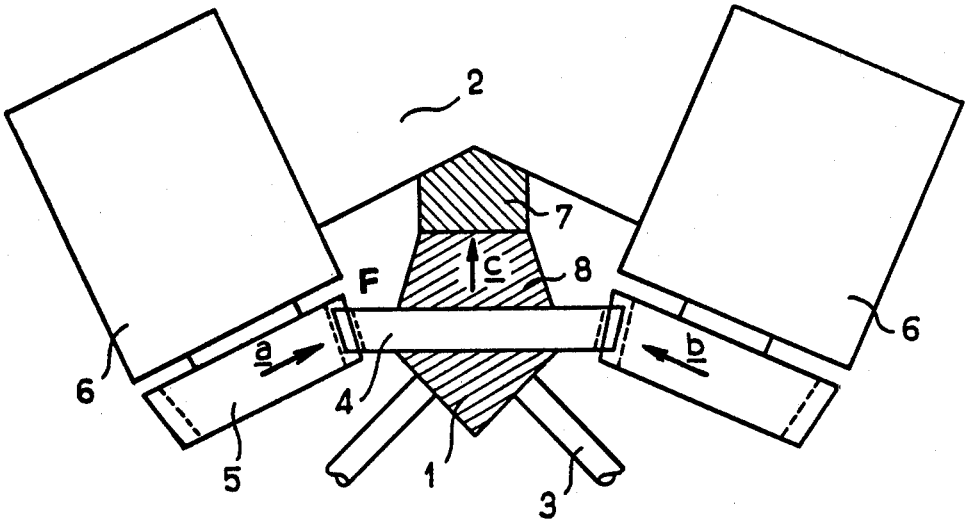
FIG. 2 is a similar view of a modification of the system of FIG. 1.

As can be observed from both FIGS. 1 and 2, the two types of stress, a and b, which are laterally transferred from the pinions 5 to the teeth situated upon the rack 4, are not in opposition, thereby producing another (resultant) type of stress c, so as to press the guide element 8 attached to the platform leg 1 against the thrust-block 7, situated upon the frame F of the jacking mechanism. Consequently, the guide element 8 is permanently in contact with the thrust-block 7, and this condition exists for each leg of the platform. Therefore, constant lateral positioning of pinion teeth 5 and the teeth situated upon the rack 4 in relation to one another is assured, and the stresses applied to the various thrust-blocks 7 are in equilibrium with one another.

The pinions 5 shown in FIG. 1 are of the conventional cylindrical type, whereas, in FIG. 2, the pinions possess a truncated cone shape, so as to permit modification of the intensity of stress c applied to thrust-blocks 7 in relation to the angles for respective shapes.

The acute angle $\alpha$ between the pinion and the rack, for the above purposes, is preferably in the range between about 1°and 10°, being desirably about 2° or 3° degrees, more or less.

Although only two preferred examples of the present invention have been portrayed, it is obvious that variants and modifications may be introduced with respect to the number and shape of components described herein, and would not constitute departures from the con-text of said invention.

It would be possible to modify the position of the thrust-block in situations where two thrust-blocks are used, so as to obtain the same result; and also possible to attach said thrust-block to the platform structure by flexible means of attachment. Further modifications will occur to those skilled in the art and are considered to fall within the spirit and scope of the invention as defined in the appended claims.

I claim:

1. In a jacking mechanism of the rack and pinion type which is intended to permit vertical adjustment of the position of an ocean platform and to maintain said platform in an appropriate position upon multiple platform legs, with at least one double rack containing opposite sets of teeth being firmly attached to each platform leg, said rack being accompanied by a jacking mechanism including at least one pair of pinions rotatably supported on the platform structure by means of a frame, with each of said pinions respectively meshing with one of the two sets of teeth located upon the said rack, in such a manner that said teeth shall be situated on either side of said rack, with the pinions being capable of turning by means of drive mechanisms and reducing mechanisms in order to provide necessary movements in one direction or another; said jacking mechanism being characterized by the improvement wherein the said rack contains sets of obliquely cut teeth, and there is provided rigid component means forming lateral thrust-block means integrally attached to the said frame and being disposed between the platform structure and each platform leg, said pinions being angulated with respect to the associated rack so that they exert forces on the rack with a component tending to press one portion of the platform leg against the thrust-block means, consequently providing constant positioning of the pinion teeth in relation to the sets of teeth situated upon the said rack.

2. A jacking mechanism as claimed in claim 1 characterized by the fact that the said pinions are of oblique shape.

3. A jacking mechanism as claimed in claim 1 characterized by the fact that the angle $\alpha$ between the pinion and the rack is between about 1° and 10°.

4. A jacking mechanism as claimed in claim 3 wherein the said angle $\alpha$ is of the order of substantially 2° to 3°.

5. In self-raising ocean platform structures and the like having multiple legs and multiple jacking mechanisms of the double rack and pinion type, the improvement wherein each said double rack has sets of obliquely cut teeth engaging associated pinions; rigid lateral thrust block means disposed between the platform structure and each platform leg and rigidly attached to said platform structure; and means for rotatably mounting the pinions on the platform structure at an angle to the associated rack to provide forces on the rack which tend to press a portion of the platform leg against the corresponding thrust block means to insure substantially constant positioning of the teeth of said pinions in relation to the associated sets of obliquely cut teeth.

6. A jacking mechanism as claimed in claim 5 characterized by the pinions being obliquely shaped.

7. A jacking mechanism as claimed in claim 5 characterized by the fact that the angle between the pinions and rack is an acute angle of a few degrees.

* * * * *